United States Patent [19]

Roberts, Jr.

[11] 4,326,000

[45] Apr. 20, 1982

[54] SOFT, ABSORBENT, UNITARY, LAMINATE-LIKE FIBROUS WEB

[75] Inventor: Clifford J. Roberts, Jr., Turnersville, N.J.

[73] Assignee: Scott Paper Company, Philadelphia, Pa.

[21] Appl. No.: 626,993

[22] Filed: Oct. 29, 1975

Related U.S. Application Data

[60] Continuation-in-part of Ser. No. 583,708, Jun. 4, 1975, Pat. No. 4,000,237, which is a division of Ser. No. 356,051, Apr. 30, 1973, Pat. No. 3,903,342.

[51] Int. Cl.[3] ..... B31F 1/12; B32B 3/28

[52] U.S. Cl. ..... 428/153; 162/112; 428/152; 428/195; 428/198; 428/212; 428/218; 428/219; 428/361; 428/913

[58] Field of Search ..... 428/152, 153, 156, 161, 428/195, 198, 219, 361, 212, 218, 913; 156/62.6, 290, 291, 183, 277; 162/112, 184, 231, 135, 111; 19/156.3, 156.4; 15/104.93

[56] References Cited

U.S. PATENT DOCUMENTS

| | | | |
|---|---|---|---|
| 2,880,111 | 3/1959 | Drelich et al. | 428/195 |
| 3,009,822 | 11/1961 | Drelich et al. | 428/195 |
| 3,079,290 | 2/1963 | Marshall | 428/198 |
| 3,214,323 | 10/1965 | Russell et al. | 428/198 |
| 3,382,072 | 5/1968 | Surowitz | 428/198 |
| 3,616,797 | 11/1971 | Champaigne et al. | 428/198 |
| 3,720,562 | 3/1973 | Drelich et al. | 428/198 |
| 3,753,826 | 8/1973 | Plummer | 428/198 |
| 3,768,118 | 10/1973 | Ruffo et al. | 19/156.3 |
| 3,908,058 | 9/1975 | Russell et al. | 428/198 |

FOREIGN PATENT DOCUMENTS 1294794 11/1972 United Kingdom .

*Primary Examiner*—James J. Bell

*Attorney, Agent, or Firm*—Joseph H. Yamaoka; John W. Kane, Jr.

[57] ABSTRACT

Disclosed is a unitary or integral laminate-like fibrous web having a first and second surface region and a central core region which has less fiber concentration than the first surface region. The first surface region has a surface disposition of bonding material disposed only in that region to form a strong, abrasion-resistant surface. The central core region has a penetrating disposition of bonding material extending through that region in a fine, spaced-apart pattern occupying less area in the plane of the web than the surface bonding material in the first surface region. The penetrating bonding material in the central core region penetrates entirely through that region and connects the first and second surface regions together by penetrating to at least within a fiber thickness of the web surface to provide abrasion-resistance for that surface region. In a preferred embodiment, the surface bonding material in the first surface region is applied in a fine, spaced-apart pattern and those areas where it is disposed have been finely creped.

17 Claims, 4 Drawing Figures

SOFT, ABSORBENT, UNITARY, LAMINATE-LIKE FIBROUS WEB

RELATED APPLICATIONS

This application is a Continuation-In-Part of U.S. patent application Ser. No. 583,708, filed June 4, 1975 now U.S. Pat. No. 4,000,237 and entitled SOFT, ABSORBENT, UNITARY, LAMINATE-LIKE FIBROUS WEB WITH DELAMINATION STRENGTH AND METHOD FOR PRODUCING IT, which in turn is a Divisional of U.S. patent application Ser. No. 356,051 filed Apr. 30, 1973, of the same title and now U.S. Pat. No. 3,903,342, issued Sept. 2, 1975.

BACKGROUND OF THE INVENTION

1. Field of the Invention

This invention relates to an integral, laminate-like fibrous sheet material made preferably from predominantly papermaking fibers and especially desirable for use as soft, absorbent, sanitary disposable towels, wipers and facial tissues.

2. Description of the Prior Art

A strong trend exists in the paper industry to develop disposable products from papermaking fibers and other fibers to serve as substitutes for conventional cloth products which are used as wipers, tissues and towels in both the home and industrial shops. To successfully gain consumer acceptance of these paper products, they must closely simulate cloth in both consumer perception and in performance. Thus, certain physical properties must be present in a successful product. These properties generally include softness, strength, stretchability, absorbency, ability to wipe dry, bulk and abrasion resistance. Depending upon the particular intended use of the product, some properties are more desirable than others.

Softness is one property which is highly desirable for almost all of the paper products regardless of their intended use. This is true not only because consumers find it more pleasant to handle soft feeling products, but also because softness enables the shape of the product to be readily conformable to the shape dictated by job requirements. Strength and the ability to stretch are two other properties which are desirable, particularly in those products which are to be used for heavy work duty. Also, it is desirable for the products to have good abrasion resistance if they are to be used for wiping, cleaning or scouring. Where the products are to be put to such uses as facial tissues, poor abrasion resistance undesirably results in pilling or dusting of fibers from the product when being handled by the consumer. Bulk is important not only because it enables the paper product to feel like cloth, but also because it is favorably interrelated to other desirable properties, such as softness and absorbency.

Some of these properties are somewhat adversely interrelated to each other. That is to say, an increase in one property is usually accompanied by a decrease in another property. For example, an increase in web density or fiber concentration (the closeness of the fibers to each other) increases the ability of the web to wipe dry or pick up moisture, due to the greater capillary action of the small spaces between the fibers. However, an increase in closeness of the fibers decreases the spaces between the fibers available for holding the moisture, and thus reduces the absorbency, in terms of quantity, of the web.

Perhaps an even more demonstrative example of the adverse interrelation between properties is represented by the relationship between strength and softness. It has generally been believed that conventional methods employed to produce soft paper necessarily result in strength reduction. This is because conventional paper products are formed from aqueous slurries, wherein the principle source of strength comes from interfiber bonds formed by the hydrate bonding process associated with papermaking. Paper which has a heavy concentration of these papermaking bonds is usually stiff. To soften the paper, it is necessary to reduce these stiff bonds, an action which also results in a loss of strength.

The method most commonly employed to reduce the stiff papermaking bonds is to crepe the paper from a drying surface with a doctor blade, disrupting and breaking many of the interfiber bonds in the paper web. Other methods which have been used to reduce these bonds contrast with creping by preventing formation of the bonds, rather than breaking them after they are formed. Examples of these other methods are chemical treatment of the papermaking fibers to reduce their interfiber bonding capacity before they are deposited on the web-forming surface, use of unrefined fibers in the slurry, inclusion into the slurry of synthetic fibers not exhibiting the ability to form papermaking bonds, and use of little or no pressing of the web to remove the water from the paper web after it is deposited on the web forming surface. This latter method reduces formation of bonds by reducing close contact of the fibers with each other during the forming process. All of these methods can be employed successfully to increase the softness of paper webs, but only with an accompanying loss of strength in the web.

Attempts to restore the strength lost by reducing the papermaking bonds have included the addition to the web of bonding materials which are capable of adding strength to a greater degree than adding stiffness to the web. One method which has been used to apply bonding materials to the web is to add the bonding material to the aqueous slurry of fibers and deposit it on the web-forming surface along with the fibers. With this method, the bonding material can be distributed evenly throughout the web, avoiding the harshness which would accompany concentrations of bonding material. However, this method has the disadvantage of reducing the absorbency of the web by filling the pores between the fibers with bonding material. It also bonds the web uniformly throughout, the disadvantage of which will be explained subsequently.

Another method which has been used to apply bonding material to the web is to apply the bonding material in a spaced-apart pattern to the web. By this method, the majority of the web surface does not contain absorbency-reducing bonding material. This method is commonly employed in the field of nonwovens where little or no strength is imparted to the web by papermaking bonds, and almost all of the strength is obtained from the bonding materials. (Some of the strength may be obtained from intertwining of fibers, where the fibers are long enough to do so). However, the fibers in such nonwoven webs are sufficiently long to enable small amounts of bonding material to impart substantial strength to the web, because adjacent areas of the bonding material in the spaced apart pattern can be quite far apart and yet be able to bond each fiber into the network.

In contrast to nonwoven webs, webs made entirely or principally from papermaking fibers require bonding areas to be quite close together because papermaking fibers are very short, generally less than one-quarter of an inch long. Thus, it has been thought that to apply sufficient bonding material in a pattern to a paper web to the degree necessary to bond each fiber into the network would result in a harsh sheet, having poor softness characteristics, particularly in the areas where the bonding material is located.

A method has been discovered which reduces the harshness in the web areas where the bonding material is concentrated. That method is disclosed in U.K. Pat. No. 1,294,794 and the related U.S. patent application Ser. No. 156,327 and, in its preferred form, consists of first forming a fibrous web under conditions which result in very low interfiber bonding strength by one of the previously described methods. Strength is then imparted to the web by applying bonding material to one surface of the web in a fine spaced-apart pattern. The harshness in the bonded areas is reduced by tightly adhering bonded portions of the web to a creping surface and removing with a doctor blade, thus finely creping the bonded portions to soften them. This form of controlled creping also results in a number of other property improvements. For example, selective creping of the bonded areas in the surface of the web creates contraction of the surface of the web in all directions, resulting in an increase in stretch in both the machine direction and the cross-machine direction of the web. Also, the portions of the web where the bonding material is not located are generally disrupted by the creping action, resulting in an increase in bulk of the web, an increase in the softness of the web, and an increase in absorbency. At certain locations within the web, close to the bonding material, the web develops internal split portions which further enhance the absorbency, softness, and bulk of the web. It is this effect on the portions where the bonding material is not located which does not exist, at least to the same extent, in the web formed by addition of bonding material to the aqueous slurry of fibers.

This method produces a paper web with outstanding softness and strength, two properties which were previously believed to be almost mutually exclusive. It also produces a web with excellent absorbency properties due to the bonding material being confined to only a minor portion of the web surface. Furthermore, the compaction of the surface fibers due to the shrinkage of the bonded portions on the web creates one surface of the web which has improved wipe-dry characteristics. It is also believed that pressing the web to a creping surface while the web has moist portions in the surface region due to the uncured or undried bonding material causes the fibers in those moist areas to compact.

This method is particularly useful in production of webs in a lower basis weight range for such use as bathroom tissues. However, it has shortcomings in making webs for heavier duty use such as for towels and facial tissues where greater strength, bulk and absorbency is desired. Examples of such shortcomings are poor abrasion resistance (or excessive pilling and dusting) and inability to hold to the web the fibers on the nonbonded side of the web, as well as less strength in the overall web than may be desired. These properties could be improved by causing the bonding material to penetrate completely through the web to create a network of bonding material which passes entirely through the web, but the web would be subjected to a lesser extent to the improvements in the properties afforded by practice of the "156,327" invention. For example, bonding the web with the bonding material extending completely through the web would greatly reduce the disruption of the fibers within the web upon creping, and therefore, result in a reduction of bulk, softness, and absorbency. Also, complete penetration of the bonding material through the web is difficult to accomplish on heavier basis weight webs and attempts to do so result in concentrations of excess bonding material at the web surface where much of it is ineffective for strengthening interfiber bonds. Furthermore, if complete penetration of the bonding material does result, the bonding material in the interior of the web will not be as efficiently used to increase abrasion resistance of the web as when it is placed only in the surface of the web. Placement of the bonding material in the interior of the web is not only an inefficient use of the expensive bonding material, but results in harsher feel to the web due to the inability of the creping action to soften the bonded portions as effectively.

Also, one desirable feature of the "156,327" invention which would be reduced by bonding completely through the web is the ability to create a web surface of compacted fibers having good wipe-dry characteristics while at the same time creating a bulky web capable of absorbing a large amount of moisture. These properties are only of minor importance when producing a product for such uses as bathroom tissues, but where the product is to be used for wipers, facial tissue or towels, it is very important. This shortcoming detracts from the "156,327" invention as a method of producing a wiper, facial tissue or towel product.

From the foregoing discussion, it can be seen that it would be very desirable and is, therefore, an object of the invention to produce a paper product which has a superior combination of bulk, absorbency, softness, strength and abrasion resistance. These desirable features are provided in the product of the invention.

SUMMARY OF THE INVENTION

The product of the invention is a unitary or integral, laminate-like sheet material of planar-aligned fibers, preferably having a basis weight from about 10 to about 100 pounds per ream of 2,880 square feet, and which has a superior combination of bulk, absorbency, softness, strength and abrasion resistance. The web of the invention has on the first side a strong, abrasion-resistant, laminate-like surface region having relatively close fiber concentration, and on the other side a surface region which is abrasion-resistant. Between the two surface regions is a soft, central core region having less fiber concentration than the first surface region, increasing the softness, bulk and absorbency of the product.

The laminate-like first surface region has surface bonding material disposed within it, preferably in a fine, spaced-apart pattern, to bond the fibers into a strong network within the surface region and to impart abrasion-resistance to that side of the web. Penetrating bonding material is disposed within the central core region in a fine, spaced-apart pattern which occupies less area in the plane of the web than the surface bonding material does in the first surface region. The penetrating bonding material in the central core region extends entirely through the central core region and connects the two surface regions together. To interconnect the two surface regions, the penetrating bonding material extends through the central core region to within at least one fiber thickness of the web surface opposite the laminate-like first surface region where it not only interconnects the two surface regions, but also increases abrasion-resistance to the second, opposite surface. The second surface region preferably has no pattern of surface bonding material apart from the penetrating bonding material and is no more than the outer surface of the central core region, in which case the web has only two planar regions.

While being extremely useful in interconnecting the two surface regions of the web and providing abrasion resistance to the second surface of the web, the penetrating bonding material in the central core region can cause many of the disadvantages described in the description of the prior art. For example, the bulking effect created by creping is lessened in those areas where bonding material penetrates through the central core region. Also, the areas of the web where the penetrating bonding material is disposed are harsher than the areas where it is not so disposed. For these reasons, the penetrating bonding material in the central core region preferably occupies a small area in the plane of the web, always less than that occupied by the surface bonding material in the laminate-like first surface region. By limiting the area occupied by the penetrating bonding material to less than about 15% of the plane of the finished web, and by uniformly distributing the penetrating bonding material in the plane of the web, the disadvantages referred to above can be substantially eliminated while still providing a web having good abrasion resistance on both surfaces. It is particularly desirable to limit the area occupied by the bonding material in the central core region to between about 0.5% to about 5%. With this distribution, the central core region will have the great majority of its portion consisting of a low concentration of fibers, adding bulk and absorbency as well as softness and compressibility to the web. In a preferred embodiment, the central core region of the web includes split portions and caverns disposed at spaced locations throughout, providing even greater bulk, softness and absorbency to the web.

In another preferred form of the web is one formed from short papermaking fibers having a predominant length less than ¼ inch and having very little interfiber bonding in those areas of the web not containing bonding material. In this type of web, practice of the invention produces a web product having both good abrasion resistance and excellent bulk, absorbency, and softness.

In another preferred form of the invention the surface bonding material in the first surface region is disposed in a fine, spaced-apart pattern which occupies between about 15% and about 60% of the surface area of that surface region and penetrates from about 10% to about 60% through the thickness of the finished web. It is greatly preferred that the bonded regions in the first surface region be finely creped by employing the bonding material in that surface region as a creping adhesive. "Fine creping" as the term is used in the specification and claims, is the resulting creping effect which occurs to the portions of a web held tightly to a creping surface with adhesive. It may manifest itself in the adhesively adhered portions in greater foreshortening and/or greater number of creping wrinkles and/or greater degree of softening than would have been obtained by creping of the same portions of the web without the use of adhesive. Where the fine creping is confined to a pattern on the web, as it is in the preferred forms of the invention, it causes the creping effect on the entire web to be predominantly concentrated in the areas of the web which are adhesively adhered to the creping surface, and thus, produces a patterned crepe.

DESCRIPTION OF THE PREFERRED EMBODIMENTS

Figure 1:
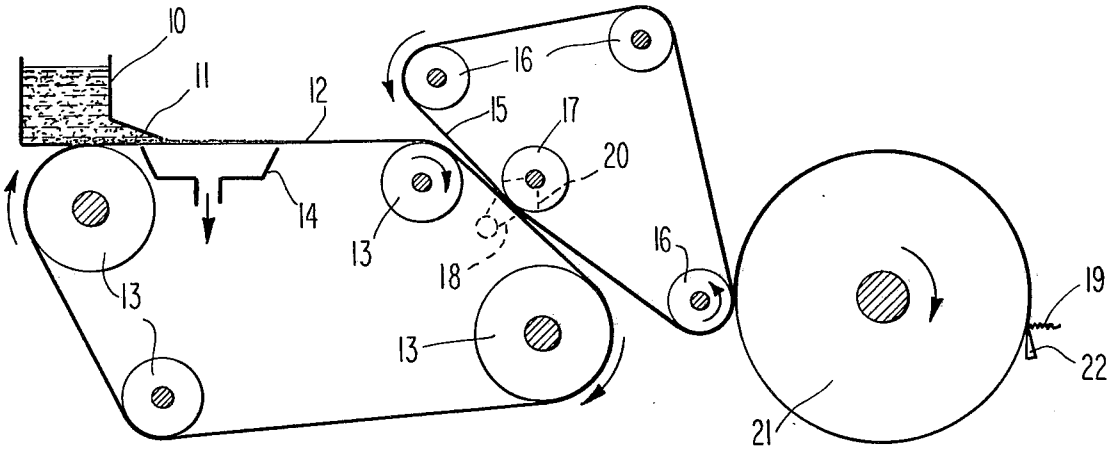
FIG. 1 is a schematic side elevation view of one form of apparatus for forming a fibrous web suitable for treatment to form the invention.

FIG. 1 schematically illustrates a papermaking machine which is capable of forming a web to which the method steps of the present invention are applied. A head box 10 is provided to hold a supply of fiber furnish, which generally comprises a dilute slurry of fibers in water. The head box 10 has slice lips 11 disposed over the moving surface of a condenser 12, which in this embodiment comprises a foraminous woven wire such as a Fourdrinier wire. The fiber furnish in head box 10 issues from the slice lips 11 onto the surface of the wire 12. The wire 12 is carried through a continuous path by a plurality of guide rolls 13, at least one of which is driven by drive means (not shown). A vacuum box 14 is disposed beneath the wire 12 and is adapted to assist in removing water from the fiber furnish in order to form a web from the fibers. In addition, other water removal means such as hydrofoils, table rolls, and the like (not shown) may be employed beneath the upper flight of the wire 12 to assist in draining water from the fiber furnish. Upon nearing the end of the upper flight of the Fourdrinier wire 12, the web is transferred to a second carrying member 15, which may be either a wire or a felt. This second carrying member 15 is similarly supported for movement through a continuous path by a plurality of guide rolls 16.

The transfer of the web from wire 12 to member 15 is accomplished by lightly pressing the carrying member 15 into engagement with the web on the wire 12 by a pickup roll 17. The web transfer from wire 12 to member 15 may be accomplished or assisted by other means such as an air knife 18 directed against the surface of wire 12 opposite the web, or a vacuum box 20 within the pickup roll 17, or both, such means being well known to those skilled in papermaking techniques. At least one of the rolls 16 or 17 supporting the second carrying member 15 is driven by means (not shown) so that member 15 has a speed preferably equal to the speed of the wire 12 so as to continue the movement of the web.

The web is transferred from member 15 to the surface of a rotatable heated dryer drum 21 such as a Yankee dryer. The web is lightly pressed into engagement with the surface of the dryer drum 21 to which it adheres, due to its moisture content and its preference for the smoother of two surfaces. In some cases, it may be desirable to apply a creping adhesive, such as animal glue, uniformly over the web surface or drum surface. As the web is carried through a portion of the rotational path of the dryer surface, heat is imparted to the web, and generally most of the moisture therein is removed by evaporation. The web 19 is removed from the dryer surface in FIG. 1 by a creping blade 22, although it could be removed therefrom by peeling it off without creping, if this were desired.

Drying may be accomplished by drying means other than the drying drum 21. Thus, the dryer may take a substantially different form, such as that shown in U.S. Pat. No. Re. 28,459. This type of dryer accomplishes the removal of moisture from the web by passing air through the web to evaporate the moisture without applying any mechanical pressure to the web. This latter feature is advantageously used in connection with the present invention for a number of reasons set forth below. In addition, a web which is dried in this manner is not usually creped, and this may be a desirable feature in certain instances.

At this point, regardless of the particular apparatus or process utilized, a base web of planar-oriented fibers is formed which can be treated in accordance with the method of the present invention to form a sheet material of the present invention. (Planar-oriented is defined as having substantially all of the fibers oriented in the plane of the web which means that none or few extend vertical (Z direction) to the plane of the web. The web preferably comprises principally lignocellulosic fibers like wood pulp or cotton linters used in papermaking, which are short fibers of less than ¼ inch length. However, the web may be formed with a portion or all of the fibers being relatively longer fibers and still retain advantages of the present invention. Examples of such relatively longer fibers are cotton, wool, rayon, regenerated cellulose, cellulose ester fibers such as cellulose acetate fibers, polyamide fibers, acrylic fibers, polyester fibers, vinyl fibers, protein fibers, fluorocarbon fibers, dinitrile fibers, nitrile fibers, and other, natural or synthetic fibers. The length of these other fibers may be up to about 2½ inches long or longer, although shorter lengths are advantageous in forming the web on conventional papermaking equipment. Furthermore, because the primary purpose of the invention is to connect surface regions of a web together through a soft, weak central core region with bonding material occupying a minor portion of that core region, the invention is less necessary and not as advantageous where longer fibers are employed in the web. The same is true if the fibers extend vertical to the plane of the web, particularly in webs no thicker than the average fiber length. The invention offers particular economic advantage where the product is paper and substantially all of the fibers are papermaking fibers. The invention also offers particular advantage where the base web is one having generally uniform fiber concentration through the thickness of the web, such as is formed by conventional papermaking techniques. Webs of this type are then processed by the steps of the invention to form laminate-like webs having a planar region of relatively concentrated fibers with a surface disposition of bonding material and an adjacent planar region of relatively unconcentrated fibers with only a penetrating disposition of bonding material.

The web 19 preferably has a basis weight such that in the finished product the basis weight will be between about 10 and about 100 pounds, and more preferably between about 15 and about 50 pounds per 2,880 square feet. This means that the web 19 upon being formed into a base web, should have a basis weight between about 9 and about 85 pounds, and more preferably between about 13 and about 45 pounds per 2,880 square feet, in practicing the preferred forms of the invention. It is sheet products in this general range which benefit most from the method of the invention since they are largely used where the features of the invention are important. And it is in this range of basis weight where the process is most successful in imparting the desired properties to the invention.

In the preferred embodiments of the present invention, the web at this point, that is, just prior to being subjected to the process steps of the invention, preferably possesses certain physical characteristics so that when it is treated by subsequent steps of the method of the invention, it is transformed into a sheet material of superior properties. Broadly described, these characteristics possessed by the web to be treated are all evidenced by a reduced amount of interfiber bonding strength in the web. The effect of such reduced interfiber bonding strength is to substantially alter a number of characteristics of the web when subjected to the process of the invention, for example, the bulk and softness of the web as well as the overall strength of the web.

Thus, although any fibrous web of planar-aligned fibers may be advantageously treated by the method of the present invention to create a softer, stronger, and generally bulkier web, the preferred form of sheet material of the present invention is made by treating webs which initially are relatively soft, bulky and quite weak. All of these properties are generally possessed by a web which has a low, interfiber bonding strength and which is formed from randomly oriented short fibers, such as papermaking fibers. The method of the present invention then imparts an improved combination of softness, bulk, absorbency, and strength, both in the plane of the web and through its thickness, to such webs.

Webs formed by deposition of dry fibers upon a forming surface, such as by conventional air laying techniques or carding techniques, will naturally be relatively weak and soft, particularly if the fibers are too short to intertwine among themselves. However, conventionally formed paper webs are generally stronger than desired for practicing the preferred form of the invention and should preferably have their interfiber bonding strength reduced. This reduced interfiber bonding strength can be achieved in several ways. Thus, in some instances, the web is creped, perhaps during its removal from the Yankee dryer 21 as shown in FIG. 1. Such a web is characterized by good softness and bulk characteristics due to the large number of interfiber bonds which are disrupted or broken during the creping operation. Such a web is also relatively weak and has good stretch characteristics, at least in the machine direction if conventionally creped, and perhaps in the cross-machine direction if creped successively in different directions, as is well known in the art.

In other instances, the fibers utilized to form the web 19 may be treated to reduce their debonding by such means as use of unrefined fibers or addition to the slurry of synthetic fibers which do not form papermaking bonds. Also, the fibers can be treated with a chemical debonder placed either in the fiber furnish, or prior to the addition of the fibers to the furnish, or even after formation of the web but prior to drying, such as when the web is carried on the wire 12. Such chemical debonders are commonly used to reduce the number of sites along the individual fibers which are susceptible to interfiber bonding of the type utilized in papermaking. Debonding agents which may be used for this purpose include the cationic debonding agents disclosed in U.S. Pat. No. 3,395,708, that is, substances within the class of long chain cationic surfactants, preferably with at least twelve carbon atoms and at least one alkyl chain, such as fatty dialkyl quaternary amine salts, mono fatty alkyl tertiary amine salts, primary amine salts, and unsaturated fatty alkyl amine salts; the cation-active tertiary amine oxides disclosed in U.S. Pat. No. 2,432,126; and the cation-active amino compounds disclosed in U.S. Pat. No. 2,432,127.

In combination with any of the methods described above, or alone, interfiber bonding strength is further reduced if the web is formed under conditions of reduced pressing while it is wet. Preferably, no mechanical pressing of the web is carried out. That is, the web is not subjected to significant compression between two elements or surfaces until it is substantially dried (preferably at least 80% dry). Thus, contrary to typical paper-making techniques, wherein a pick-up roll is used to press a felt into engagement with a web on a wire to transfer the web from the wire to the felt, this transfer may be accomplished by the use of air or vacuum or both. The alternative arrangement shown in phantom lines in FIG. 1 illustrates the manner in which this can be accomplished.

The use of any of these systems accomplishes web transfer without the application of pressure in any substantial amount to the web. Consistent with these systems, the web should not be pressed while wet into engagement with a surface of the Yankee dryer by means such as a pressure roll, a step commonly done on conventional papermaking machines, but rather drying should be accomplished through the use of air flowing over or through a web as by the transpiration drying process disclosed in U.S. Pat. No. Re. 28,459. The fibers forming the web are therefore not pressed into intimate engagement with one another while the web is wet, and the number of contact points between fibers is reduced, resulting in a reduction of interfiber bonding strength. Such conditions of reduced pressing are preferably maintained until the web is substantially dried so that few interfiber bonds are formed.

Of course, the foregoing clearly indicates that a press section, such as is conventionally used to extract moisture from a freshly formed web prior to thermal drying, should not be employed when practicing the preferred method of the invention. Such a press section results in substantial compaction of the web, thereby increasing the number of interfiber bonds and the resulting interfiber bonding strength of the web when it is dried.

The best web softening results are obtained when the fibers in the web are treated with a chemical debonder, or when the web is formed under conditions of little or no pressing while it is wet, or when a combination of the above conditions is present, and then creping the web. This is believed to be due to the fact that creping has a very substantial bulking effect on webs which have very low interfiber bonding strength. Since bulk and softness are properties which the method of the present invention is utilized to obtain, it is desirable to optimize those properties in the web prior to treatment by the method of the present invention in order to enable them to be even further improved. But, regardless of the particular form of the web, treatment by the method of the present invention will enhance the bulk, softness and strength properties and impart substantial stretch to it in addition to improving other properties desirable in a wiper product.

Figure 2:
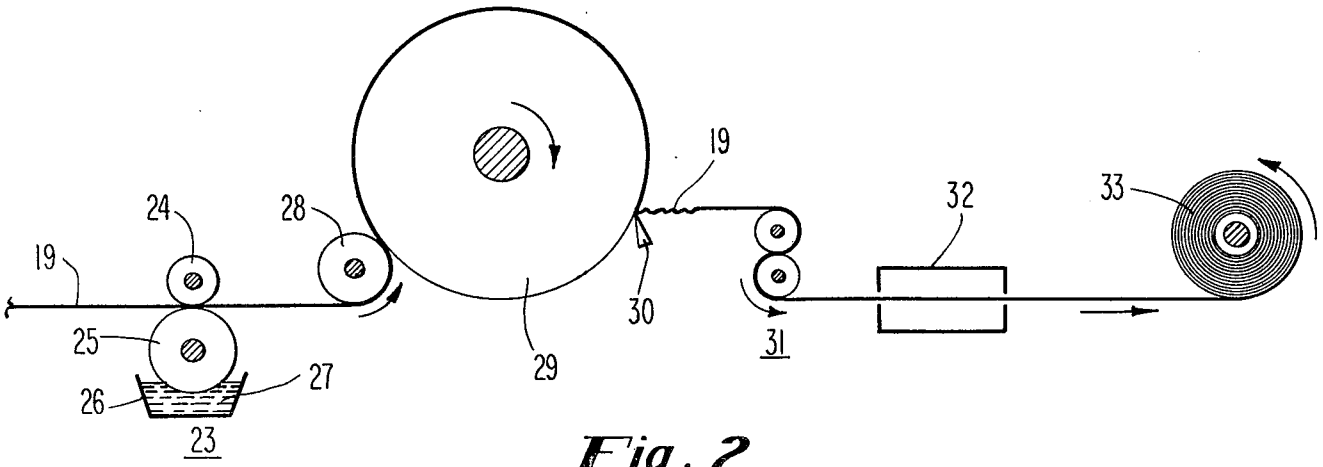
FIG. 2 is a schematic side elevation view of a portion of one form of apparatus for treating a fibrous web to form the invention.

Referring to FIG. 2, one form of apparatus for treating a fibrous web to form the invention is illustrated. In this apparatus, the web 19 which may have been formed on the apparatus illustrated in FIG. 1, or by other means previously described, is passed through a bonding-material application station 23. This station 23 includes a nip formed by a smooth rubber press roll 24 and a patterned metal rotogravure roll 25 equipped with a metering doctor or other metering means. The lower transverse portion of the rotogravure roll 25 is disposed in a pan 26 containing a bonding material 27. The rotogravure roll 25 applies in its engraved pattern, bonding material 27 to one surface of the web 19 as the web 19 passes through the nip. Rotogravure roll 25 includes two engraved patterns. The first engraved pattern applies a surface disposition of bonding material to generally bond one surface region of the web, but not to interconnect both surfaces of the web. The second engraved pattern on rotogravure roll 25 applies a penetrating disposition of bonding material to penetrate through to the second surface of the web and interconnect the two surfaces together. To accomplish the different degrees of penetration of the bonding material from the two different patterns, the engraved depth of the gravure pattern for the second pattern is greater than that for the first pattern. Thus, a larger amount of bonding material is released from the second pattern and deeper penetration of the bonding material is accomplished. After application of the bonding material to one surface of web 19, the web 19 is then pressed into adhering contact with the creping drum surface 29 by the press roll 28, and the bonding material 27 causes only those portions of the web 19 where it is disposed to adhere tightly to the creping surface 29. The web 19 is carried on the surface of the creping drum 29 for a distance and then removed therefrom by the action of a conventional creping doctor blade 30, which performs a fine creping operation on the bonded portions of the web 19. That is, it imparts a series of fine fold lines to the portions of the web 19 which adhere to the creping surface 29. At the same time, the creping action causes the unbonded or lightly bonded fibers in the web portion to puff up and spread apart, forming shaped web portions having excellent softness and bulk characteristics. The extent and form of this type of crepe is controlled primarily by the pattern in which the web is adhered to the creping drum 29.

The creping surface 29 can be provided by any form of surface to which the bonding adhesive will tightly adhere to enable creping of the web 19 from the surface 29. Preferably, the creping surface 29 is heated to increase the adhesion of the web to the drum and to dry the web. An example of a suitable creping surface is a Yankee dryer.

The web 19, having been controlled pattern creped, is pulled from the creping doctor blade 30 through a pair of driven pullrolls 31 which control the degree of crepe folds left in the web by the difference in their speeds and the speed of the creping surface. The web 19 is then optionally passed through curing or drying station 32 to cure or dry the bonding material on the surface and inside of the web 19, if further cure is required. The curing or drying station 32 may be of any form well known by those skilled in the art, such as ovens energized by infrared heat, microwave energy, hot air, etc.

After passing through the curing or drying station 32, the web 19 is wound into a parent roll 33 by conventional winding means (not shown). It may then be transferred to another location to cut it into commercial size sheets for packaging.

Some variation is permissible in the bonding-material application station 23. For example, the penetrating disposition of bonding material can be applied in a second bonding-material application station (not shown) separate from the first station 23 in which case the penetrating disposition of bonding material could be applied to the surface of the web opposite the surface on which the surface disposition was applied. Also, the bonding-material application station can be provided by means other than a rotogravure roll, such as flexographic means and spraying means, including the use of silk screening.

The pattern of surface bonding material applied to the web 19 is preferably in a form of fine lines or fine, discrete areas which preferably leaves a substantial portion of the surface of the web 19 free from bonding material. The width or thickness of the lines can be varied, depending to some extent upon the length of the fibers in the web. An example of a satisfactory width for webs of short fibers is about 0.01 inches. Preferably, the pattern should be such that the surface bonding material occupies between about 15% and about 60% of the total surface area of each surface of the web, leaving between about 40% and about 85% of the surface of the web free from bonding material in the finished web product. The patterns disclosed in U.S. Pat. Nos. 3,047,444; 3,009,822; 3,059,313; and 3,009,823 may be advantageously employed. Some migration of bonding material occurs after printing, and the pattern of the rotogravure roll is chosen accordingly. Thus, the bonding material penetrates into the thickness of the web 19 and in all directions of the plane of the web 19. To practice the most preferred form of the invention, migration in all directions in the plane of the web should be controlled to leave areas of between about 50% and about 75% of the finished web surface free from any bonding materials.

It has been found to be particularly desirable when the web consists principally of papermaking fibers for the patterns of bonding material in the surface regions to be reticular patterns so the bonding material forms a net-like web of strength through the surface of the web. It is well known that papermaking fibers generally have a length less than about ¼ inch and normally have a predominant fiber length less than about 1/16 of an inch in length. Therefore, where strength is to be primarily imparted to a sheet by bonding material, as in the preferred form of the present invention, instead of through interfiber bonds of the type conventionally utilized in papermaking, it is important that there be a continuous interconnection of at least some of the fibers by the bonding material throughout the entire web. If the pattern of bonding material is in the form of parallel lines, bars, or other forms of discrete areas, the web will lack substantial strength unless such discrete areas are spaced apart by distances less than the average fiber lengths. However, when the pattern of surface bonding material is reticular or net-like in configuration, the interconnected lines of bonding material provide a network of strength even where substantial areas are defined between the lines of bonding material application as unbonded web portions.

The pattern of penetrating bonding material which penetrates through the web to interconnect the surface regions may be in any form of fine lines or fine discrete areas, which occupy less area in the plane of the web than the surface bonding material. Because the penetrating bonding material is applied primarily for the purpose of tying the two surfaces of the web together and providing abrasion resistance to the weakest surface, it is not necessary that it cover a very large percent of the surface area of the web, and it is disadvantageous for reasons discussed above. Preferably, this pattern occupies less than about 15% of the plane area of the web, and even more preferably, from about 0.5% to about 5%. It has been found that a small dot, about 1/32 of an inch in diameter is a good shape and size for this pattern. When the web is made from very short fibers (such as papermaking fibers), it is preferable to space the penetrating dots of bonding material closer, less than ⅛ inch apart and even as close as 1/32 inch apart. Of course, it is to be recognized that the dot does not necessarily have to be circular, but could be any other shape which is functionally equivalent, such as a square or rectangle, etc. It is highly desirable that the penetrating bonding material in this pattern be uniformly spaced to maximize the distance between adjacent locations of bonding material. It should be noted here that the location of the penetrating bonding material in this pattern does not necessarily have to be apart from the location of the surface bonding material in the surface regions, but could be superimposed in spaced locations upon the pattern of surface bonding material in a surface region. It should also be noted here that the percentage area in the plane of the web referred to herein is measured at the location in the web where the penetrating bonding material occupies the largest area. In most cases, this location is the surface in which the penetrating bonding material was applied.

It has been discovered that the pattern of penetrating bonding material is preferably provided by elongate segments when the fibers in the web have a predominant alignment in one direction. For example, most of the fibers in carded webs are aligned in the machine direction (MD) of the web, and in the typical papermaking operation, a greater number of the fibers align in the machine direction than in any other direction although the fibers are generally randomly oriented. The predominant direction of fiber alignment can be detected from the tensile strength being greater in some directions than others. Conventional paper commonly exhibits three or more times greater strength in the MD than in the cross machine direction (CD). By aligning the elongate dimension of the binder segments transverse to the predominant direction of fiber alignment, a smaller amount of penetrating bonding material can be employed. For example, aligning the elongate dimension of the bonding material segments in the CD on a web of conventional paper will permit maximum efficient use of the penetrating bonding material.

Migration and penetration of the bonding materials is influenced, and thus can be controlled, by varying the basis weight of the web itself and by varying the pressure applied to the web during application of the bonding material thereto, since wicking through the web is enhanced when the fibers are compacted closely together. Also, changing the nature of the bonding material, its surface tension, and its viscosity will affect migration and penetration of the bonding material. In addition, varying the amount of time between application of the bonding material and setting or curing of the material will affect penetration, as well as will varying base web moisture content and pressure roll loading at the dryer. A determination of the exact required conditions is easily within the skill of a papermaker without undue experimentation once he decides which bonding material he wishes to use and how much penetration he wishes. It should be noted here that at occasional locations, some of the bonding material will penetrate further or less than desired due to inherent process deviations. The critical and preferred ranges of bonding material penetration and migration expressed herein, therefore, refers only to the great majority of the web and does not preclude the possibility of occasional variances.

Where the penetrating bonding material is applied from the same rotogravure roll as the surface bonding material, all of these factors described above for controlling migration and penetration of the bonding material will be the same for both patterns. Therefore, the greater penetration desired for one pattern must be obtained through design of the pattern of the rotogravure roll itself. This is accomplished by using deeper engraved cells for one pattern than for the other pattern. Thus, the amount of penetration of the bonding material into the web is controllable by the depth of the bonding material in the rotogravure roll cell. Of course, where the penetrating bonding material is applied from a separate rotogravure roll, depth of penetration can be controlled by other factors, such as viscosity of the bonding material.

The bonding material utilized in the process and product of the preferred forms of the present invention must be capable of several functions, one being the ability to bond fibers in the web to one another and the other being the ability to adhere the bonded portions of the web to the surface of the creping drum so that the web may be controlled pattern creped. In general, any material having these two capabilities may be utilized as a bonding material, if the material can be dried or cured to set it. Among the bonding materials which are capable of accomplishing both of these functions and which can be successfully used are acrylate latex rubber emulsions, useful on unheated as well as heated creping surfaces; emulsions of resins such as acrylates, vinyl acetates, vinyl chlorides, and methacrylates, all of which are useful on a heated creping surface; and water soluble resins such as carboxy methyl cellulose, polyvinyl alcohol, and polyacrylamide. However, in other instances, the bonding material may comprise a mixture of several materials, one having the ability to accomplish interfiber bonding and the other being utilized to create adherence of the web to the creping surface. In either instance, the materials are preferably applied as an integral mixture to the same areas of the web. Such materials may also comprise any of the materials listed above, mixed with a low molecular weight starch, such as dextrin, or low molecular weight resin such as carboxy methyl cellulose or polyvinyl alcohol. It should be noted here that when practicing the form of the invention which does not require controlled pattern crepe, the bonding material can be chosen for its ability to bond fibers together only. Also, the bonding material penetrating through the central core region of the web can be chosen for its ability to bond fibers together only whether or not controlled pattern crepe is practiced if the penetrating bonding material is applied separately from the surface bonding material.

In producing the preferred products of the present invention, elastomeric bonding materials are employed which are basically materials which are capable of at least 75% elongation without rupture. Such materials generally should have a Young's modulus by stretching which is less than 25,000 psi. Typical materials may be of the butadiene acrylonitrile type, or other natural or synthetic rubber latices or dispersions thereof with elastomeric properties, such as butadiene-styrene, neoprene, polyvinyl chloride, vinyl copolymers, nylon, vinyl ethylene terpolymer. The elastomeric properties may be improved by the addition of suitable plasticizers with the resin.

The amount of bonding material applied to the web can be varied over a wide range and still obtain many of the benefits of the invention. However, because the preferred uses for the products of the invention are for absorbent wiper products, and particularly sanitary paper products, it is desirable to keep the amount of bonding material to a minimum. In the preferred forms of the invention, it has been found that from about 1½% to about 15% of total bonding material (based upon dry fiber weight of the finished web product) is satisfactory, and from about 3½% to 8% is preferred.

The creping drum 29 may in some instances comprise a heated pressure vessel such as a Yankee dryer, or in other instances may be a smaller roll and may be unheated. It is characterized by an extremely smooth, polished surface to which the bonding material applied to the web adheres. The necessity for heating depends upon both the characteristics of the particular bonding material employed and the moisture level in the web. Thus, the bonding material may require drying or curing by heating in which case the creping drum may provide a convenient means to accomplish this. Or, the moisture level of the web being fed to the creping drum may be higher than desired, and the creping drum may be heated to evaporate some of this moisture. It should be noted here that some bonding materials may not require the curing or drying step effected by the curing or drying station 32.

The amount of creping applied to the web during each controlled pattern creping step may be varied and still obtain good benefits from the invention. However, it has been found that from about 3% to about 20% produces a desirable product, and from about 7% to about 12% is preferred.

Figure 3:
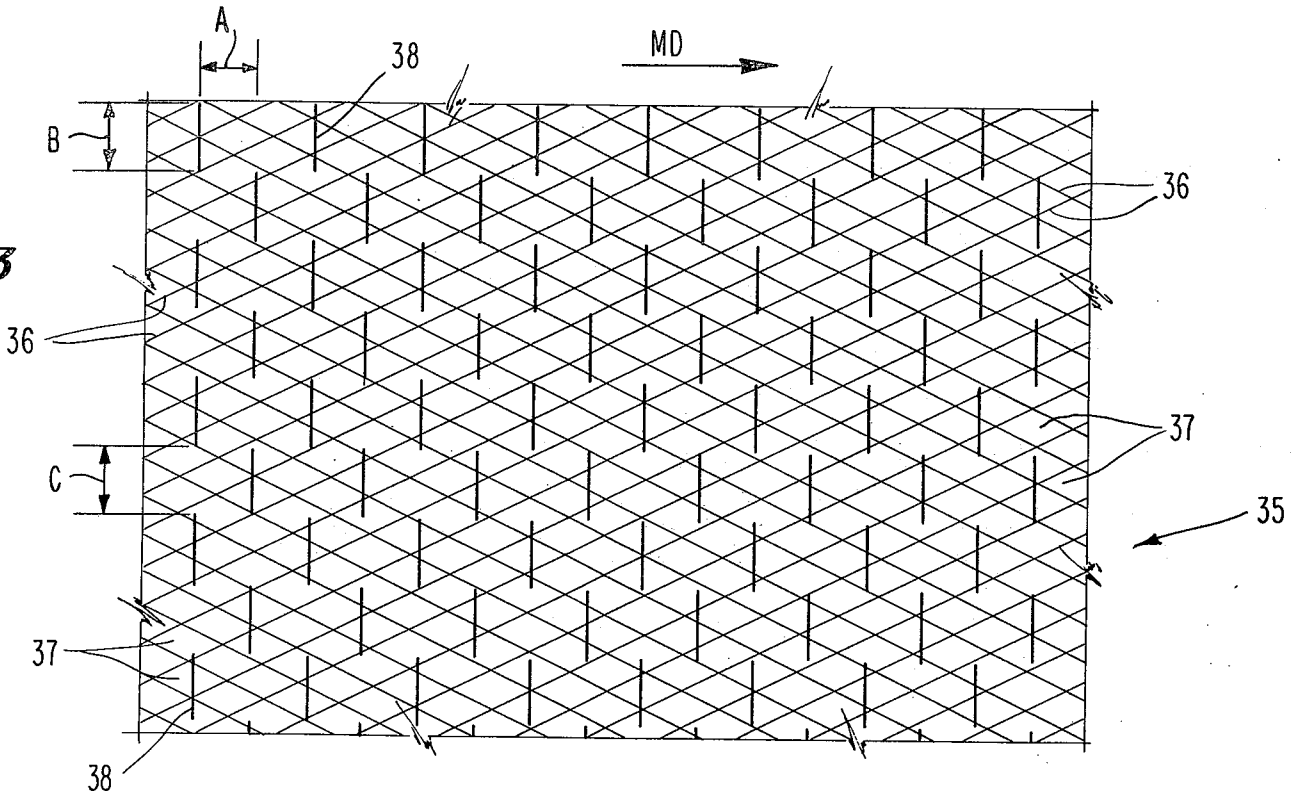
FIG. 3 is a greatly enlarged planar view of a portion of one side of the sheet material of the invention.

FIG. 3 illustrates the preferred form of sheet material of the present invention in which surface bonding material 36 in the surface region of the web 35 is in a reticular net-like pattern forming discrete, discontinuous surface areas 37 where the surface bonding material 36 is not disposed. At uniformly spaced-apart locations on the web 35, a penetrating disposition of bonding material 38 has been applied in another pattern. The penetrating bonding material 38 in this pattern is shown as discrete segments of dashes or elongated lines. The penetrating bonding material 38 extends through the web to connect the two surface regions together.

Figure 4:
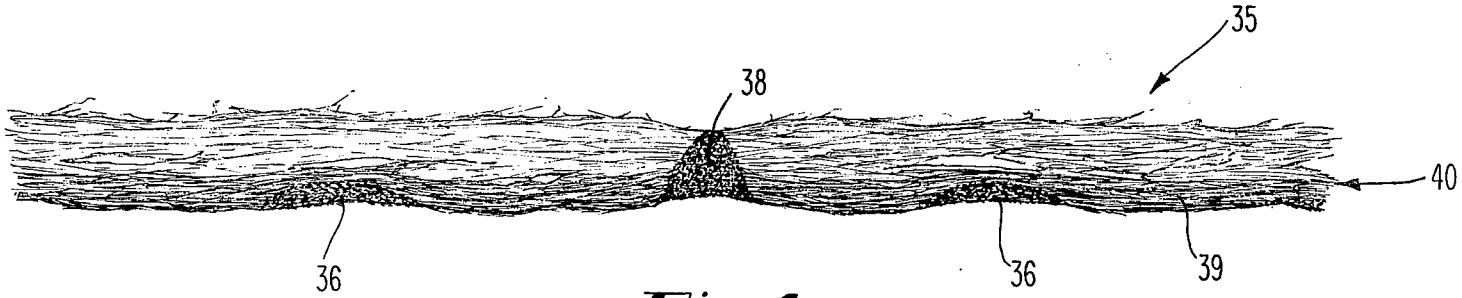
FIG. 4 is a greatly enlarged edge view of a portion of the sheet material of the invention in a cut-away view through the sheet material of the invention.

FIG. 4 illustrates a cross-sectional view of a sheet like that illustrated in FIG. 3. FIG. 4 was drawn from a photomicrograph of an actual sheet of the present invention which was made from a slurry mixture of 100% unrefined dry lap wood pulp fibers formed into a base sheet having a basis weight of 14 lbs./2,880 ft.$^2$. The base sheet was formed on an apparatus similar to that illustrated in FIG. 1 except that a transpiration dryer like that disclosed in U.S. Pat. No. Re. 28,459 was substituted for the Yankee dryer 21 and was processed by the method of the invention on an apparatus similar to that illustrated in FIG. 2. The finished product had a basis weight of 18 lbs./2,880 ft.$^2$ and a bulk of 0.225 inches per 24 sheets at 235 grams/in.$^2$ load. The sample was stained to distinguish the fibers from the bonding material and cut in the machine direction. The sample was magnified 45 times in the photograph and the drawing is approximately to the same scale.

Still referring to FIG. 4, the sheet material 35 displays a first planar or laminate-like surface region 39 and a central core region or second planar region 40, all in a single-ply, unitary or integral web. The web is generally undulating due to creping and has surface bonding material 36 disposed at spaced locations in a fine, spaced-apart pattern in the first surface region 39 of the web 35.

Penetrating bonding material 38 extends from the first surface region 39 of the web entirely through the central core region or second planar region 40 and interconnects with the opposite surface of the web. It should be noted that it is only necessary for penetrating bonding material 38 to penetrate to within a fiber thickness of the opposite surface of the web 35, it being recognized that in planar-aligned fibrous webs, the fibers orient themselves generally in the plane of the web.

The surface bonding material 36 bonds at least some of the fibers together to form bonded web portions located throughout the first surface region 39. The unbonded web portions are only held together by bonds which are formed on the web prior to application of the bonding material 36 and, as pointed out above, preferably have very low interfiber bonding strength.

It is preferred that the surface bonding material 36 migrate through only a minor portion of the thickness of the web. It is important to the invention that the surface bonding material 36 does not generally extend all the way through the web 35. It is the portions of the web which do not have the surface bonding material 36 applied in the steps of the invention that are most greatly affected by the creping step to form the soft, absorbent central core region or second planar region 40. The best way to assure that excessive penetration of the surface bonding material 36 does not occur is to limit penetration of the surface bonding material 36 to no more than about 40% through the thickness of the finished web product 35. More preferably this surface bonding material 36 extends less than about 30% through the thickness of the web.

However, it is also highly preferable in order to obtain the greatest advantage of the invention, that the surface bonding material 36 penetrates a significant distance into the web 35 from the surface, at least 7% of the web's thickness and more preferably at least 15%. This degree of penetration will assure formation of the desirable properties in the surface region 39 as described above.

Still referring to FIG. 4, the first surface region 39 in the web 35 has a greater concentration of fibers than the central core region 40, creating two laminate-like or planar regions. The greater concentration of fibers in the first surface region 39 is caused in part by the contraction of the surface bonded regions upon controlled pattern creping the web and by the resistance to disruption of the surface region of the web upon creping, due to strength imparted by the surface bonding material 36. The first surface region 39 is generally coextensive with the penetration of the surface bonding material 36. The central core or second planar region 40 has split regions or cavities throughout generally close to surface bonding material 36. These cavities result from the creping effect upon the central core region or second planar region 40, having fibers which are not held tightly together, along with the general reduction of fiber concentration. It is this action which greatly enhances the bulk and softness of the web in addition to substantially increasing its absorbtive capacity.

The bonded regions shrink or contract when subjected to controlled pattern creping and compact the fibers together in the surface region in that surface, thus permitting elongation of the web in both the cross-machine direction (CD) and the machine direction (MD) due to the ability of the compacted fibers to separate when the sheet is subjected to tension. Therefore, the resulting sheet material possesses substantial stretch in all directions in its plane. In this manner, the method of the invention provides a simple and convenient process for creating multidirectional stretch in a web without the complexity and difficulty in the prior art methods discussed above, such as creping the web twice in different directions. To illustrate, sheet materials of the present invention typically have stretch in the machine direction up to about 30% and stretch in the cross-machine direction up to about 25%.

Furthermore, when the portions of the first surface region 39 not having bonding material are compacted or compressed to force the fibers closer together, the closer fibers decrease the sizes of the openings between the fibers and, therefore, increase the capillary action of moisture drawn into the web. This results in better wipe-dry properties of the web. This is especially beneficial in dry formed fibrous webs and aqueous formed webs of reduced interfiber bonding, where the fibers generally are not as tightly compacted upon being formed into a web as might be desired for wipe-dry properties.

Referring back to FIG. 3, the penetrating bonding material 38 is disposed in a preferred pattern of discrete elongated segments. The elongate dimension "B" of each segment 38 is aligned in the CD direction of web 35, which is transverse to the predominant fiber direction (MD) in the typical paper web 35 represented in FIG. 3. If the predominant fiber direction were in some other direction, the alignment of dimension "B" would be changed preferably to another direction which would be perpendicular to the predominant fiber direction.

The segments of penetrating bonding material 38 are illustrated in FIG. 3 in their preferred pattern of rows aligned in the CD and which are spaced apart by dimension "A". Each segment is offset from the segments in adjacent rows. Dimension "A" is chosen to be less than ½ of the average fiber length apart so that each fiber on the second surface of the web will likely be attached to a segment of penetrating bonding material 38. Thus, dimension "A" for conventional paper is preferably between about 0.05 inches and about 0.10 inches. If the segments aligned with the segments in adjacent rows, dimension "A" would be chosen to be less than average fiber length.

The length "B" of each segment 38 could be almost any length, but for aesthetic appearance, a length of from about 0.10 inches to about 0.3 inches is preferred. The spacing "C" between each segment 38 in the row is preferably chosen to be approximately equal to segment length "B" when the segments 38 in each row align with the spaces "C" between segments 38 in adjacent rows, as illustrated in FIG. 3.

A fibrous web suitable for sanitary paper products was formed from a slurry of 100% bleached sulphate pulp containing approximately 70% Softwood and 30% Hardwood pulp. The sheet was formed on a suction-forming roll and transferred to a drying fabric under conditions of little or no pressing. The sheet was fully dried by passing hot air through the web, and the dried sheet had a basis weight of 14 lbs./2,880 ft.$^2$. The sheet was cut into several example webs for further treatment. All of the example webs were subjected to an application of surface bonding material from an apparatus like that illustrated in FIG. 2. The surface disposition of bonding material was in an elongated diamond pattern of 80 mils×60 mils (the longer dimension being aligned in the MD of the web) and a pattern repeat length of 0.130 inches. The engraved lines of the diamond pattern were 0.0135 inches wide and approximately 35 microns deep. They occupied approximately 33% of the peripheral surface area of the gravure roll.

Each example had a different pattern or disposition of penetrating bonding material applied to it. The penetrating bonding material was applied at the same time as the surface bonding material through use of a second engraved pattern, deeper than the first, superimposed on the first engraved pattern in the rotogravure roll. The bonding material applied for both dispositions was a water emulsion of AIRFLEX 105 at 44% solids, 0.5% ammonium chloride and 1% FOAMASTER VF defoamer (all percentages based on total solids). AIRFLEX 105 is a self-crosslinking ethylene vinyl acetate copolymer emulsion produced by Air Products and Chemicals of Wayne, Pa., and used primarily as a nonwoven binder. The general properties of the bonding material fluid upon being applied to the web was: viscosity of 75 centipoise at 25° C.; pH of 4.5, and specific gravity of 0.035 at 70° F.

Each example web after applying the bonding material was pressed against a 3 ft. diameter cast iron creping drum by a 6 in. diameter elastomer press roll having a teflon sleeve. The creping drum was electrically heated to a surface temperature of 175° F., and the drum surface speed was 100 feet per minute. The webs were creped from the drum at an average dryness of 95 percent, and the bonding material was cured by passing it through an infrared oven. The webs were creped 15 percent, resulting in 15% foreshortening of the web in the MD. Each example web had a basis weight of 18 lbs. per ream of 2,880 square feet.

In order to determine the abrasion resistance existing on the second side of the web opposite the strong, first surface region, each example web was subjected to a pilling test to measure the tendency of the fibers to be rubbed from the web when handled. The pilling test employed was as follows. The examples were cut into test strips 1 inch wide and 4.5 inches long with the MD direction corresponding to the longer dimension. Each test strip was weighed, and then clamped in spaced-apart jaws positioned to drape the test strip over a spindle with the second side of the web in contact with the spindle. The jaws were weighted with a total of 103 grams. The spindle was then moved back and forth against the test strip 50 cycles (each cycle is a back and forth stroke), removing loose fibers from the web surface. The test sample was then weighed and compared to its pre-test weight to determine fiber loss. Five test strips were tested and averaged for each example. The result for each example was compared with a Standard sample consisting of the same web without the penetrating bonding material.

The following is a description of the pattern of penetrating bonding material and pilling test results for each example. The dimensions indicated by letters refer to FIG. 3 and were measured on the first side of the web. The patterns were all like that illustrated in FIG. 3.

EXAMPLE I

"A"—0.055 inches
"B"—0.135 inches
"C"—0.180 inches.

The "B" dimensions was aligned in the CD. The segments were produced by engraved slots in the rotogravure roll having a width of 0.0134 inches and a depth of 95.2 microns. The width or thickness of each segment on the web was measured to be 0.012 inches. The total surface area occupied by the penetrating bonding material was 8.8%. The pilling test resulted in 35% less fiber loss than the Standard.

EXAMPLE II

"A"—0.100 inch average (varied from 0.050 to 0.150 inches)
"B"—0.134 inch
"C"—0.180 inch.

The "B" dimension was aligned in the CD. The segments were produced by engraved slots in the rotogravure roll having a width of 0.018 inches and a depth of 91.2 microns. The width or thickness of each segment on the web was measured to be 0.014 inches. The total surface area occupied by the penetrating bonding material was 5.6%. The pilling test resulted in 25% less fiber loss than the Standard.

EXAMPLE III

"A"—0.150 inch
"B"—0.139 inch
"C"—0.320 inch.

The "B" dimension was aligned in the CD. The segments were produced by engraved slots in the rotogravure roll having a width of 0.019 inch and a depth of 107.8 microns. The width or thickness of each segment on the web was measured to be 0.012 inch. The total surface area occupied by the penetrating bonding material was 2.2%. The pilling test resulted in 7.8% less fiber loss than the Standard.

EXAMPLE IV

"A"—0.55 inch average (varied from 0.030 to 0.080)
"B"—0.095 inch
"C"—0.210 inch.

The "B" dimension was aligned in the MD (the pattern was revolved 90° to that illustrated in FIG. 3). The segments were produced by engraved slots in the rotogravure roll having a width of 0.0173 inch and a depth of 99.3 microns. The width or thickness of each segment on the web was measured to be 0.017 inch. The total surface area occupied by the penetrating bonding material was 7.9%. The pilling test resulted in 27% less fiber loss than the Standard.

The examples illustrate the improvement in abrasion resistance on the second side of the web which can be obtained with preferred patterns of penetrating bonding material. Thus, aligning the long dimension "B" of the segments in the CD of the web (which is transverse to the predominant fiber direction of the web) produces better pilling resistance than alignment in the MD—35% (Example I) compared to 27% (Example IV). (The fibrous sheet from which the example webs were made had a MD tensile strength of 25 oz./inch and a CD tensile strength of 8 oz./inch.) Also, the spacing "A" between adjacent rows of segments is shown to be a critical factor in producing better pill resistance. Thus, a spacing "A" of 0.055 produced a 35% improvement (Example I); 0.100 produced 25% improvement (Example II); and 0.150 produced 7.8% improvement (Example III).

Having described the invention, I claim:

1. Fibrous sheet material comprising, a soft, absorbent, unitary, laminate-like web of substantially planar-aligned fibers, the web having first and second surface regions, each on one side of a central core region, the central core region having less fiber concentration than the first surface region, only one of said surface regions having a surface disposition of bonding material extending only through said surface region, a second, penetrating disposition of bonding material extending through the central core region and connecting the first and second surface regions together, the second penetrating disposition of bonding material being in a fine, spaced-apart pattern occupying less area in the plane of the web than the one, surface disposition of bonding material, whereby, the outer surface of the other surface region is interconnected to the one surface region with bonding material.

2. Fibrous sheet material according to claim 1, wherein the basis weight of the web is from about 10 to about 100 pounds per ream of 2,880 square feet and the web is characterized as having a very low interfiber bonding strength in the areas where bonding materials are not disposed, the first, surface disposition of bonding material is in a fine, spaced-apart pattern occupying from about 15% to about 60% of the surface area of the web in the first region, and the second, penetrating disposition of bonding material occupies less than about 15% of the area in the plane of the web, and the first surface region occupies from about 10% to about 60% of the web thickness.

3. Fibrous sheet material according to claim 2, wherein the second, penetrating disposition of bonding material is a plurality of discrete elongated segments with the elongate dimension of each segment being positioned transverse to the predominant alignment direction of the fibers.

4. Fibrous sheet material according to claim 3, wherein the segments are aligned in rows which extend in the same direction as the alignment of the elongate dimension of each segment, and the distance between each segment and the adjacent segments in the direction of predominant fiber alignment is no greater than the average fiber length.

5. Fibrous sheet material according to claim 1, wherein the fibers in the web are randomly oriented in the plane of the web and have a predominant length less than ¼ inch.

6. Fibrous sheet material according to claim 1, wherein the first, surface disposition of bonding material is in a fine, spaced-apart pattern occupying from about 15% to about 60% of the surface area of the web in the first surface region and penetrating from about 10% to about 60% through the thickness of the web, and the surface areas in the first surface region where the first, surface disposition of bonding material is disposed are finely creped.

7. Fibrous sheet material according to claim 5, wherein the first surface disposition of bonding material is in a fine, spaced-apart pattern occupying from about 15% to about 60% of the surface area of the web in the first surface region and penetrating from about 10% to about 60% through the thickness of the web, and the surface areas in the first surface region where the bonding material is disposed are finely creped.

8. A fibrous sheet material comprising a soft, absorbent, unitary, laminate-like web of fibers randomly oriented in the plane of the web and having a predominant length of less than ¼ inch, the web having a basis weight of from about 15 to about 50 pounds per ream of 2,880 square feet, the web having a soft, tough first planar region and a soft, absorbent second planar region having less fiber concentration than the first region, bonding material disposed in a fine, spaced-apart, first pattern in the first region of the web to occupy from about 15% to about 60% of the surface area of the first region, and penetrating into the web to a depth of from about 10% to about 60% of the web thickness, the portions of the first region where the bonding material is disposed in the first pattern being finely creped, and bonding material disposed in a fine, spaced-apart second pattern in the first region of the web to occupy from about 0.5% to about 15% of the surface area of the first region, and penetrating to at least within one fiber thickness of the opposite surface of the web, whereby, the outer surface of the second planar region is interconnected to the first planar region with bonding material.

9. A sanitary paper product comprising a soft, absorbent, unitary, laminate-like single-ply web of papermaking fibers and having a basis weight of from 15 to about 50 pounds per ream of 2,880 square feet;

the web having a soft, strong first planar region and a soft, absorbent second planar region having less fiber concentration than the first region;

bonding material dispersed in a fine, spaced-apart first pattern in the first region of the web occupying from about 15% to about 60% of the surface area of the first region, and penetrating into the web to a depth of from about 10% to about 60% of the web thickness; and bonding material disposed in a fine, spaced-apart second pattern in the second planar region of the web to occupy from about 0.5% to about 15% of the surface area of the web and penetrating through the second planar region from the first planar region to at least within one fiber thickness of the outer surface of the second planar region, whereby the outer surface of the second planar region is interconnected to the first planar region with bonding material.

10. Sanitary paper product according to claim 9, wherein the portions of the first planar region where the first pattern of bonding material is disposed are finely creped.

11. Sanitary paper product according to claim 9, wherein the second pattern of bonding material is a plurality of discrete elongated segments with the elongate dimension of each segment being positioned transverse to the predominant alignment direction of the fibers.

12. Sanitary paper product according to claim 11, wherein the MD tensile strength of the web is greater than the CD tensile strength of the web, and the segments are disposed with their elongate dimension in the CD direction.

13. Sanitary paper product according to claim 12, wherein the segments are aligned in rows in the CD direction, and each row is spaced from adjacent rows by a distance in the MD direction of from about 0.05 inches to about 0.10 inches.

14. Sanitary paper product according to claim 13, wherein each segment is between about 0.10 inch and about 0.30 inch long and spaced apart from adjacent segments in its row by a distance about equal to its length.

15. Sanitary paper product according to claim 14, wherein the segments in each row align with the spaces between the segments in adjacent rows.

16. Sanitary paper product according to claim 15, wherein the portions of the first region where the first pattern of bonding material is disposed are finely creped.

17. Fibrous sheet material according to claim 1, wherein the basis weight of the web is from 10 to about 100 pounds per ream of 2,880 square feet.

* * * * *